US007076846B2

(12) United States Patent
Arai

(10) Patent No.: US 7,076,846 B2
(45) Date of Patent: Jul. 18, 2006

(54) TAPE FOR SLIDE FASTENERS

(75) Inventor: Shintaro Arai, Kahoku (JP)

(73) Assignee: Arai Weaving Ltd., Ishikawa (JP)

( * ) Notice: Subject to any disclaimer, the term of this patent is extended or adjusted under 35 U.S.C. 154(b) by 7 days.

(21) Appl. No.: 10/858,781

(22) Filed: Jun. 2, 2004

(65) Prior Publication Data

US 2004/0250384 A1 Dec. 16, 2004

(30) Foreign Application Priority Data

Jun. 10, 2003 (JP) ..... 2003-164962

(51) Int. Cl.
*A44B 19/34* (2006.01)

(52) U.S. Cl. ..... 24/432

(58) Field of Classification Search ..... 24/432
See application file for complete search history.

(56) References Cited

U.S. PATENT DOCUMENTS

| | | | | |
|---|---|---|---|---|
| 1,895,172 A | | 1/1933 | Prentice | |
| 2,000,795 A | * | 5/1935 | Sweeney | 24/432 |
| 2,084,499 A | * | 6/1937 | Newman | 24/432 |
| 2,097,475 A | | 11/1937 | Silberman | |
| 2,145,551 A | | 1/1939 | Marinsky | |
| 2,288,105 A | * | 6/1942 | Plotkin | 24/432 |
| 2,866,245 A | * | 12/1958 | Elgin | 24/432 |
| 2,997,766 A | * | 8/1961 | McNamara | 24/432 |
| 3,827,085 A | * | 8/1974 | Ackermann | 2/234 |
| 5,444,898 A | * | 8/1995 | Norvell | 24/432 |

FOREIGN PATENT DOCUMENTS

| | | |
|---|---|---|
| GB | 547783 | 9/1942 |
| JP | A 07-079815 | 3/1995 |

* cited by examiner

*Primary Examiner*—Robert J. Sandy
(74) *Attorney, Agent, or Firm*—King & Schickli, PLLC

(57) ABSTRACT

A tape for slide fasteners is provided, which comprises a fastener tape 1 having one side edge that defines a zipper element tab 3 and the other side edge that defines a seam allowance 4. The fastener tape 1 is provided on its front surface with a covering tape 2 having at an edge an enclosure 6 for covering a zipper element 5 along its full length thereof. The enclosure 6 is a double-weaving enclosure through which core yarns 8 are inserted to form a core cord 9. The enclosure may be ornamented.

1 Claim, 5 Drawing Sheets

TAPE FOR SLIDE FASTENERS

This application claims priority to Japanese Patent Application No. 2003-164962 filed on Jun. 10, 2003.

TECHNICAL FIELD

The present invention relates to a tape for slide fasteners, which protects a slide fastener mounted on a fastener tape from viewing from the front, and has aesthetical properties as well.

BACKGROUND ART OF THE INVENTION

So far, a tape for slide fasteners, which is provided along one side edge with a double-weaving portion through which a core cord comprising core yarns is passed, has been proposed as set forth in JP-A 7-79815 (Japanese Patent Unexamined 7-79815). However, this core cord is designed to make zipper element attachment easy rather than to conceal up the zipper element.

Never until now is there any tape for slide fasteners that serves well to conceal a zipper element in such a way as to keep it from being visible from the front. Thus, as a conventional tape is sewn onto the edge of a placket or other folding area of clothing, there is still a problem that the slide fastener is visible from the front, rendering the cloth unattractive.

Meanwhile, an ornamented tape for slide fasteners has been proposed in the art. However, this is not again designed to conceal the slide fastener.

Accordingly, when a slide fastener is fixed to clothing, sewing must be carried out in such a way as to cover the slide fastener with the same clothing fabric, thereby keeping it out of sight; sewing is very cumbersome.

However, when the slide fastener is covered with a relatively thin, flat fabric, the slider often catches in the fabric upon sliding contact with the slider.

SUMMARY OF THE INVENTION

In view of the above problems, an object of the invention is to provide a tape for slide fasteners, which keeps a zipper element attached to a fastener tape from being visible from the front, and possesses aesthetic properties as well.

According to the first aspect of the invention, this object is achieved by the provision of a tape for slide fasteners, which comprises a fastener tape having one side edge that defines a zipper element tab and the other side edge that defines a seam allowance, characterized in that the front surface of the fastener tape is provided with a covering tape having at an edge an enclosure for covering a zipper element along its full length thereof.

Thus, the zipper element is concealed and kept invisible from the front surface of the fastener tape, because the zipper element mounted on the zipper element tab of the fastener tape is concealed along its full length by the enclosure of the covering tape provided at the front surface of the fastener tape.

Since the zipper element is covered with the enclosure, it is unlikely that the slider of the slide fastener catches in the enclosure even upon contact therewith during sliding, unlike a thin, flat fabric.

According to the second aspect of the invention, the tape for slide fasteners as recited in the first aspect is further characterized in that said enclosure is a double-weaving enclosure through which a plurality of core yarns are inserted to form a core cord.

Thus, the core cord has so flexibility that the whole flexibility of the covering tape is kept intact, facilitating attachment of the zipper element.

The double-weaving enclosure can have improved aesthetic properties because characters, pictures and patterns can be applied thereto.

According to the third aspect of the invention, the tape for slide fasteners as recited in the first or second aspect is further characterized in that the enclosure is substantially round in section.

Thus, it is unlikely that the slider of the slide fastener catches in the enclosure even upon touch with the enclosure during sliding. Such touch, if any, is mild.

According to the fourth aspect of the invention, the tape for slide fasteners as recited in the first, second or third aspect is further characterized in that a plurality of such enclosures are juxtaposed.

Thus, more enhanced aesthetic properties are obtainable because stereoscopic changes can be given to the outward appearance of the covering tape.

According to the fifth aspect of the invention, the tape for slide fasteners as recited in the first, second, third or fourth aspect is further characterized in that the enclosure is ornamented.

Thus, more enhanced aesthetic properties are obtainable because the enclosure can be provided with attractive ornaments such as colors, characters, pictures and patterns that are different from those of a flat portion.

According to the sixth aspect of the invention, the tape for slide fasteners as recited in the first, second, third, fourth or fifth aspect is further characterized in that the seam allowance of the fastener tape and the distal end of the covering tape are formed of a single fabric.

According to the seventh aspect of the invention, the tape for slide fasteners as recited in the first, second, third, fourth or fifth aspect is further characterized in that the fastener tape and the covering tape are formed of a single fabric that is folded double substantially at the middle thereof and sewn together at the seam allowance.

According to the eighth aspect of the invention, the tape for slide fastener as recited in the first, second, third, fourth or fifth aspect is further characterized in that the fastener tape and the covering tape are separately provided, and the distal end of the covering tape is sewn to the seam allowance of the fastener tape.

The tapes for slide fasteners as recited in the sixth, seventh and eighth aspects of the invention have the same functions as do those according to the first, second, third, fourth and fifth aspects of the invention.

BRIEF DESCRIPTION OF THE DRAWINGS

Embodiments of the present invention are now explained with reference to the accompanying drawings.

EMBODIMENTS OF THE INVENTION

Figure 1:
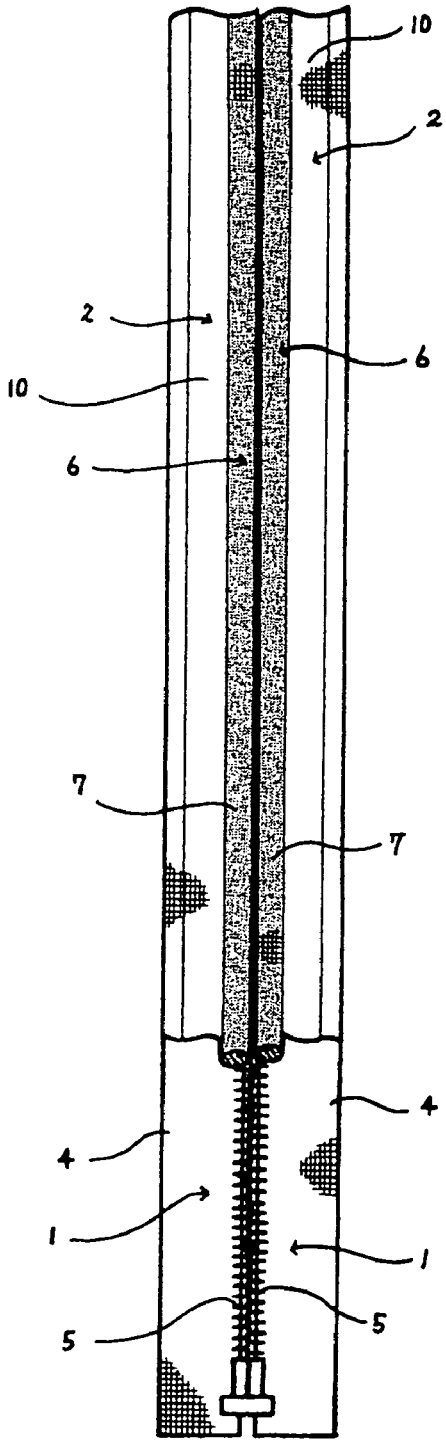
FIG. 1 is a front view of part of one embodiment of the invention in use.
Figure 2:
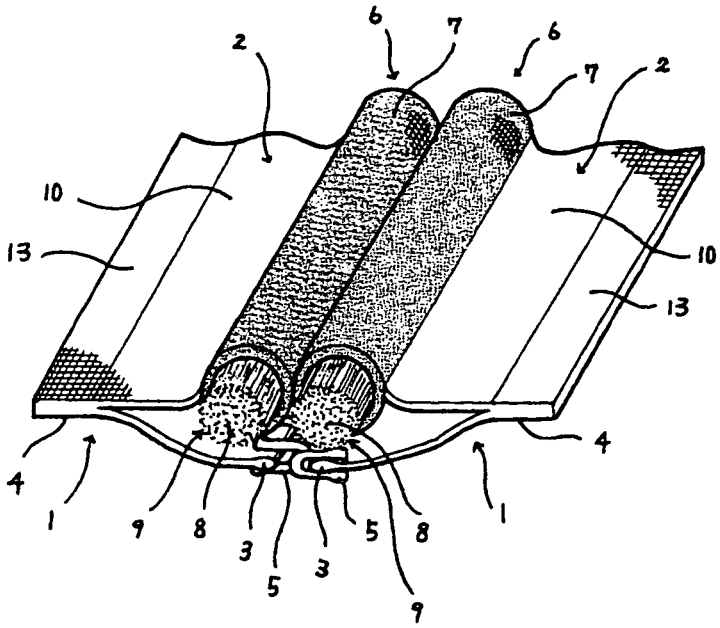
FIG. 2 is a partly enlarged perspective view of FIG. 1.

As shown in FIGS. 1 and 2, the tape for a slide fastener according to the invention comprises a fastener tape 1 and a covering tape 2 provided on the front surface of the fastener tape 1.

The fastener tape 1 is provided along one side edge with a zipper element tab 3 and along the other side edge with a seam allowance 4 that is to be sewn onto clothing.

It is noted that the fastener tape 1 is a plain-weaving tape and the zipper element tab 3 is slightly thicker than the plain-weaving fabric.

It is also noted that the fastener tape 1 may be of every known construction.

The covering tape 2 is provided lengthwise along its edge with an enclosure 6 that is to conceal the front surface of a zipper element 5 mounted at the zipper element tab 3 of the fastener tape 1.

As shown in FIG. 2, the enclosure 6 is woven or knitted into such a double-weaving form 7 as to receive therein a core cord 9 comprising a plurality of core yarns 8. Preferably but not exclusively, the enclosure 6 is substantially round in section.

Alternatively, the enclosure 6 may be formed by sewing, weaving or knitting to the edge of the fastener tape 1 the core cord in a restrained form wherein core yarns are mutually entangled.

The covering tape 2 is woven or knitted of polyester fiber yarns or blended yarns, and a part 10 thereof except the double-weaving portion 7 is formed by plain weaving. A polyester fiber yarn, blended yarn or the like is also used for each core yarn 8.

Another embodiment of the invention wherein two enclosures 6 are juxtaposed along the end of the covering tape 2 is now explained with reference to FIG. 3.

The two enclosures 6, each receiving a core cord 9, are lined off by dividing a double-weaving enclosure 7 by means of sewing thread 11. The number of enclosures 6 may be selected as desired.

Figure 3:
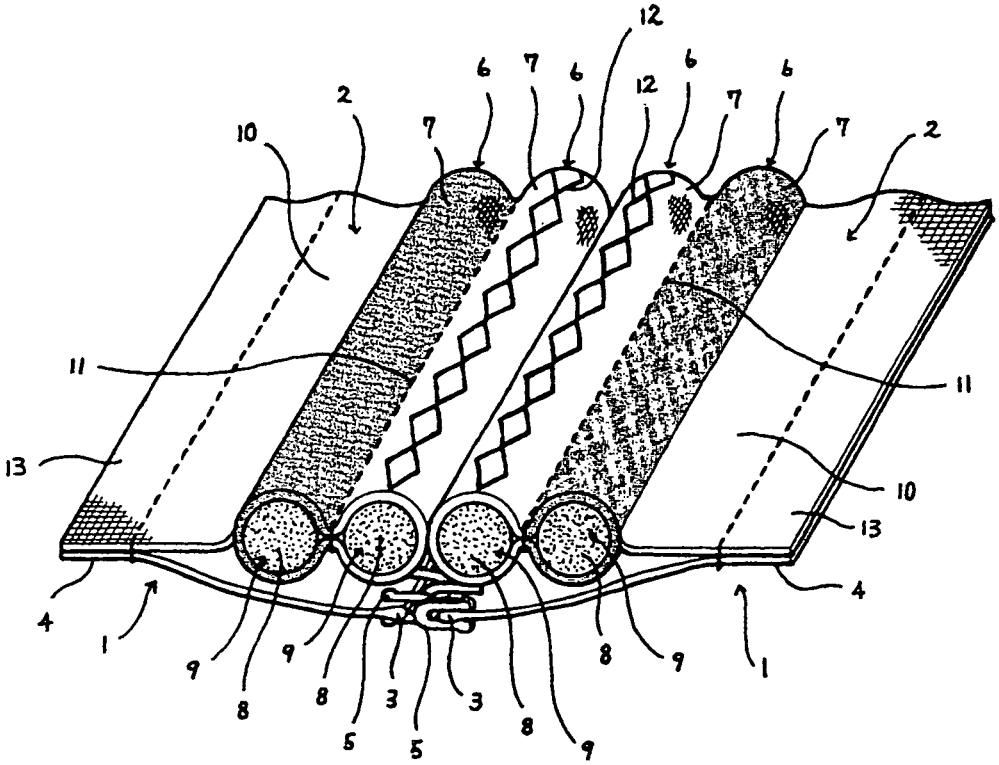
FIG. 3 is a partial perspective view of another embodiment of the invention in use.

As shown in FIG. 1 to FIG. 7, more enhanced color effects may be obtained by double weaving the double-weaving 7 with dyed yarns of a color different from that of the plain-weaving part 10. Alternatively, as shown in FIG. 3, characters, pictures, patterns or the like may be applied to the double-weaving portion 7 to give an aesthetic ornament 12 thereto. As a matter of course, the covering tape 2 may be ornamented all over the surface.

Figure 4:
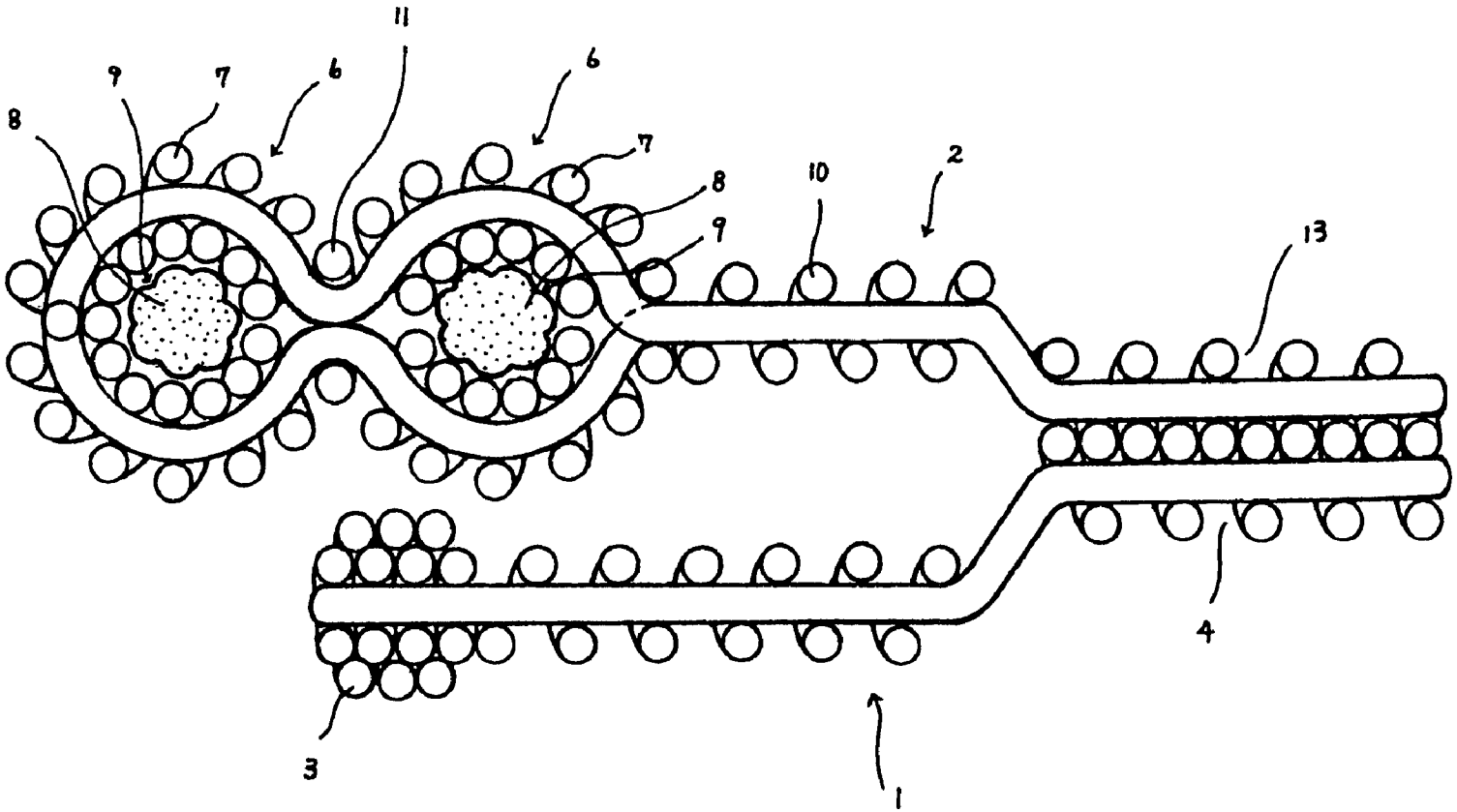
FIG. 4 is illustrative of one embodiment of the sixth aspect of the invention in use.
Figure 5:
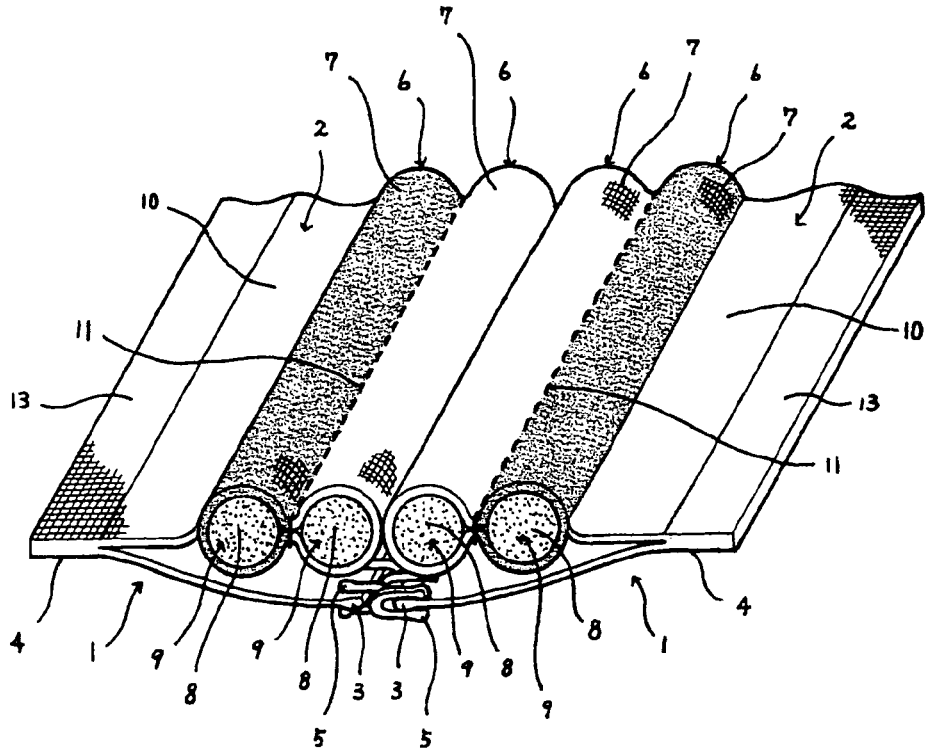
FIG. 5 is a partial perspective view of the sixth aspect of the invention in use.

One embodiment of the sixth aspect of the invention is now explained with reference to FIG. 4. As shown, a seam allowance 4 of a fastener tape 1 is made integral with a distal end 13 of a tape 2.

To this end, a weaving machine capable of carrying out weaving in two directions at one time is used. A double-weaving portion 7 is formed at an edge of a plain-weaving portion 10 on the surface of a covering tape 2 and, at the same time, the surface of a fastener tape 1 is provided at a flat, plain-weaving fabric with a zipper element tab 3 composed of a fabric that is slightly thicker than the plain-weaving fabric. Then, a seam allowance 4 is prepared with such a fabric that the plain-weave fabric of the seam allowance and the distal end 13 of the covering tape 2 are in a single fabric form with the distal end divided in two.

Figure 6:
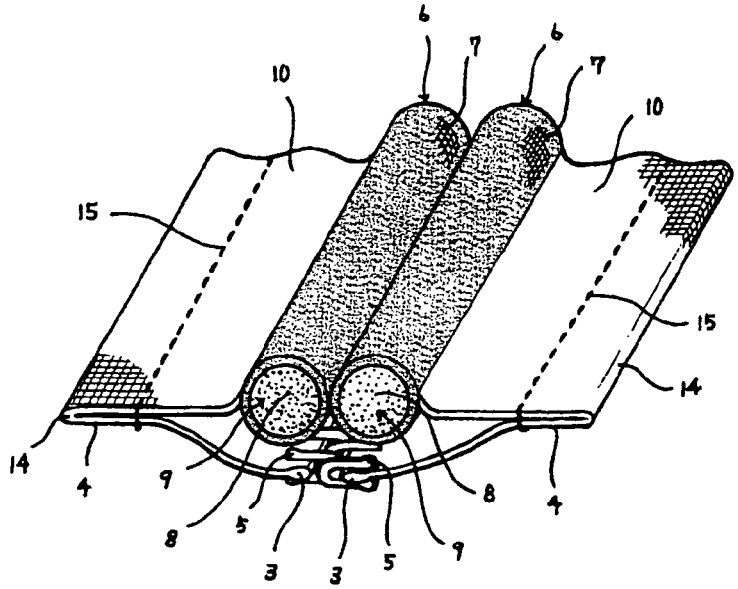
FIG. 6 is a partial perspective view of the seventh aspect of the invention in use.

Referring now to FIG. 6 that is illustrative of the seventh aspect of the invention, a single plain-weaving fabric is provided at one end with a double-weaving portion 7 and at the opposite end with an zipper element tab 3, and a fold 14 is provided substantially at the middle thereof so that the plain-weaving fabric is folded double along the fold 14 and sewn together with sewing thread 15 by means of a sewing machine.

Figure 7:
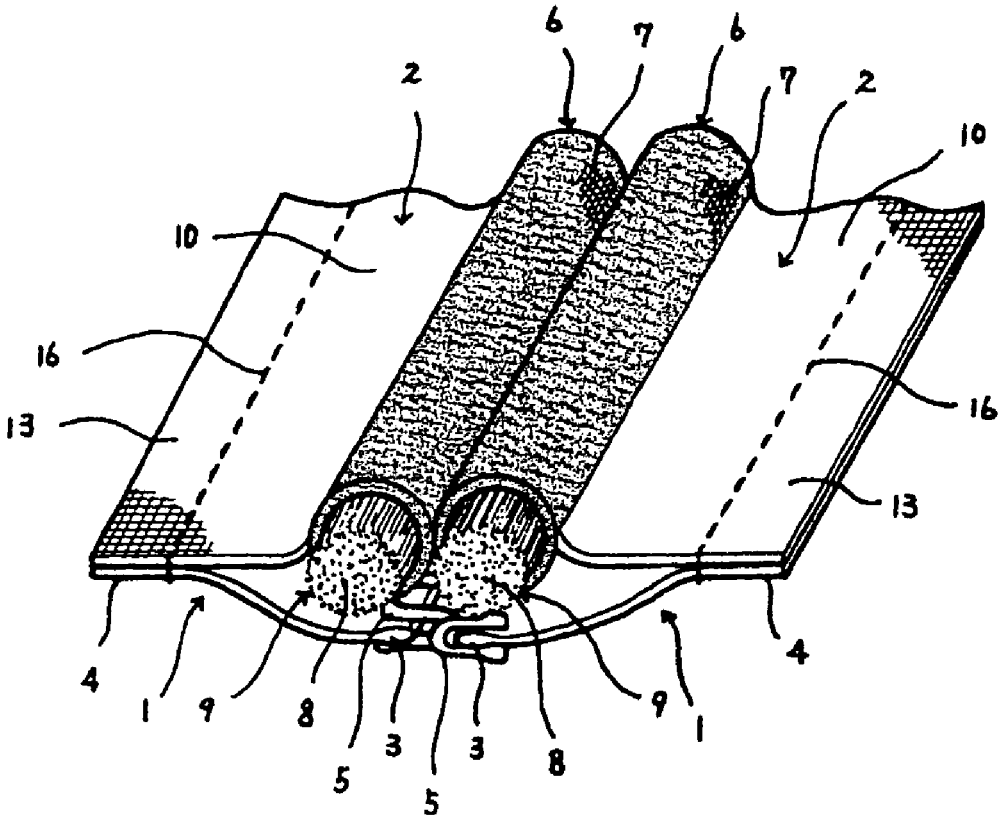
FIG. 7 is a partial perspective view of the eighth aspect of the invention in use.

Referring then to FIG. 7 that is illustrative of the eighth aspect of the invention, a fastener tape 1 and a covering tape 2 are separately provided, and a distal end 13 of the covering tape 1 is sewn by sewing thread 16 to a seam allowance of the fastener tape 1.

While the invention has been explained specifically with reference to its embodiments, it is understood that the invention is by no means limited thereto.

According to the tape for slide fasteners according to the invention as described above, the zipper element is concealed and invisible from the front surface of the fastener tape, because the zipper element mounted on the zipper element tab of the fastener tape is concealed along its full length by the enclosure of the covering tape provided at the front surface of the fastener tape, so that with the fastener tape attached to clothing, etc., the outward appearance of clothing is kept intact. In addition, it is unnecessary to conceal the slide fastener with clothing fabric, making sewing easy.

Since the slide fastener is covered with the enclosure, it is unlikely that the slider of the slide fastener catches in the enclosure even upon contact therewith during sliding, unlike a thin, flat fabric. If the enclosure is substantially round in section, the effect on prevention of catching-in can then be much more enhanced.

Since the enclosure is so formed at the double-weaving portion that the core cord can have flexibility, the whole flexibility of the covering tape is kept intact, making attachment of the zipper element easy.

If a plurality of enclosures are juxtaposed, it is then possible to give stereoscopic changes to the outward appearance of the covering tape. In addition, much more enhanced aesthetic properties are obtainable by applying colors to the enclosures with dyed threads or ornamenting them with characters, pictures, patterns or the like. Attachment of these enclosures to clothing gives rise to one-point accents.

What is claimed is:

1. A tape for slide fasteners, which comprises a fastener tape having one side edge that defines a zipper element tab, the zipper element tab having a zipper element mounted thereon, and another side edge of the fastener tape that defines a seam allowance, wherein the fastener tape is provided on a front surface thereof with a covering tape having at an edge a plurality of enclosures juxtaposed to each other for covering the zipper element along its full length thereof, and for preventing the slide fastener from catching the enclosures during sliding.

* * * * *